United States Patent [19]

Korn

[11] Patent Number: 4,573,737

[45] Date of Patent: Mar. 4, 1986

[54] CHAIR WITH A HEIGHT-ADJUSTABLE BACK REST

[76] Inventor: Heinrich Korn, Hindemithstrasse 23, Maintal 4, Del.X, 8906

[21] Appl. No.: 530,109

[22] Filed: Sep. 7, 1983

[30] Foreign Application Priority Data

Sep. 7, 1982 [DE] Fed. Rep. of Germany ..... 3233104

[51] Int. Cl.[4] ..... B60N 1/06

[52] U.S. Cl. ..... 297/353; 297/296

[58] Field of Search ..... 297/353, 354, 396, 410, 297/451, 296; 292/336.3, 121, 128, 220, 228

[56] References Cited

U.S. PATENT DOCUMENTS

| | | | |
|---|---|---|---|
| 1,867,600 | 7/1932 | Schwarzkopf | 297/410 |
| 1,977,159 | 10/1934 | Tursi | 297/410 X |
| 3,317,231 | 5/1967 | Lindquist et al. | 292/336.3 |
| 4,221,430 | 9/1980 | Frobose | 297/353 |
| 4,384,742 | 5/1983 | Wisniewski | 297/353 |
| 4,451,084 | 5/1984 | Seeley | 297/353 |

*Primary Examiner*—William E. Lyddane

*Assistant Examiner*—José V. Chen

*Attorney, Agent, or Firm*—Wigman & Cohen

[57] ABSTRACT

A chair has a height-adjustable back rest (27), a back rest support (1) and an adjusting member (2) which supports the back rest. The adjusting member (2) is guided on the back rest support (1) and is movable relative thereto. A detent mechanism (9,26), which can be released against the effect of compression spring (22), is provided between the back rest support (1) and the adjusting member (2). An activating member (10,11) of the detent mechanism (9,26) is pivotably mounted relative to the adjusting member (2) by a mounting bolt (6) and is connected with a detent member (7) which cooperates with one detent hole (26) of several detent holes (26) provided in the back rest support (1). In order to be able to arrange the activating location within wide limits at any desired distance from the detent location with the use of simple parts, the mounting bolt (6) is arranged with its axis horizontal. At least one of its upwardly bent ends is formed as an activating arm of the activating member (10,11).

9 Claims, 5 Drawing Figures

CHAIR WITH A HEIGHT-ADJUSTABLE BACK REST

BACKGROUND OF THE INVENTION

1. Field of the Invention

The invention relates to a chair with a height adjustable back rest.

2. Description of the Prior Art

In a known chair of the above-mentioned type, the adjusting member supports a double-armed activating member which is pivotable about a basically vertical axis. The detent number is arranged on the end of this activating member facing the back rest support and an activating knob is arranged on the other end. The back rest is rigidly connected with the telescope-like adjusting member in the back rest support as shown in West Germany Utility Model No. 79 18 476.

SUMMARY AND OBJECT OF THE INVENTION

The object of the present invention is to be able to arrange the activating point within wide limits at any desired distance from the detent point by using simple means. This object is achieved by the characteristics of the present invention. Because of the horizontal arrangement of the mounting bolt, this bolt can be extended over the entire width of the back rest and the activating point or location can be arranged at any desired location in the longitudinal direction of the mounting bolt.

An additional function of the mounting bolt can also be achieved by using the characteristics of the present invention. By this means, it is possible to pivotably mount the back rest about the axis of the mounting bolt which serves to mount the detent device. This arrangement saves a great deal of space whereby elements already present are used to their full advantage. The detent spring acts on both the detent member and also on the mounting body which is rigidly connected with the back rest.

Two height adjustment mechanisms for the back rest of an office chair are schematically illustrated in the drawings as objects of the invention.

DETAILED DESCRIPTION OF THE PREFERRED EMBODIMENTS

Figure 1:
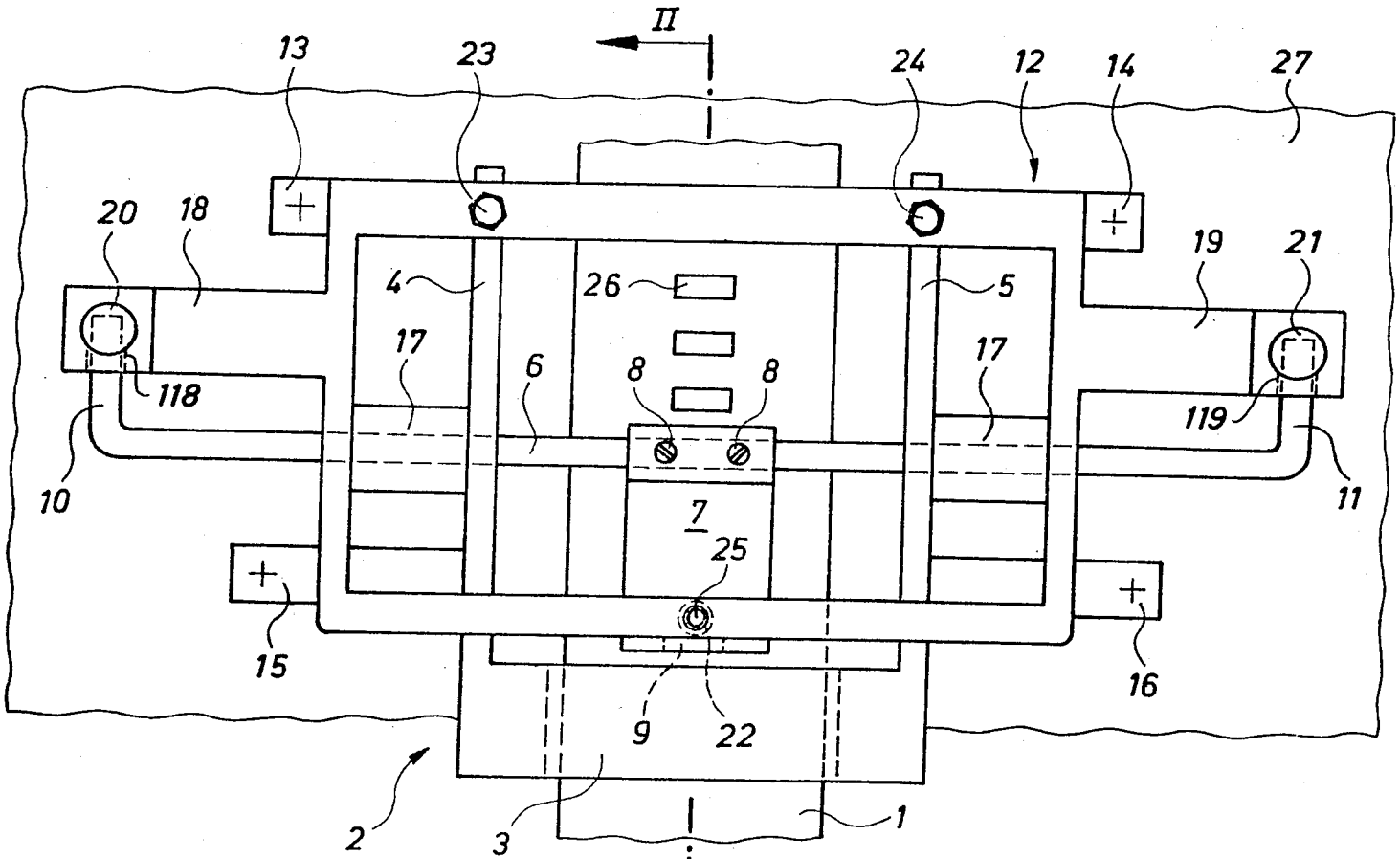
FIG. 1 is a rear view of a first exemplary embodiment.
Figure 2:
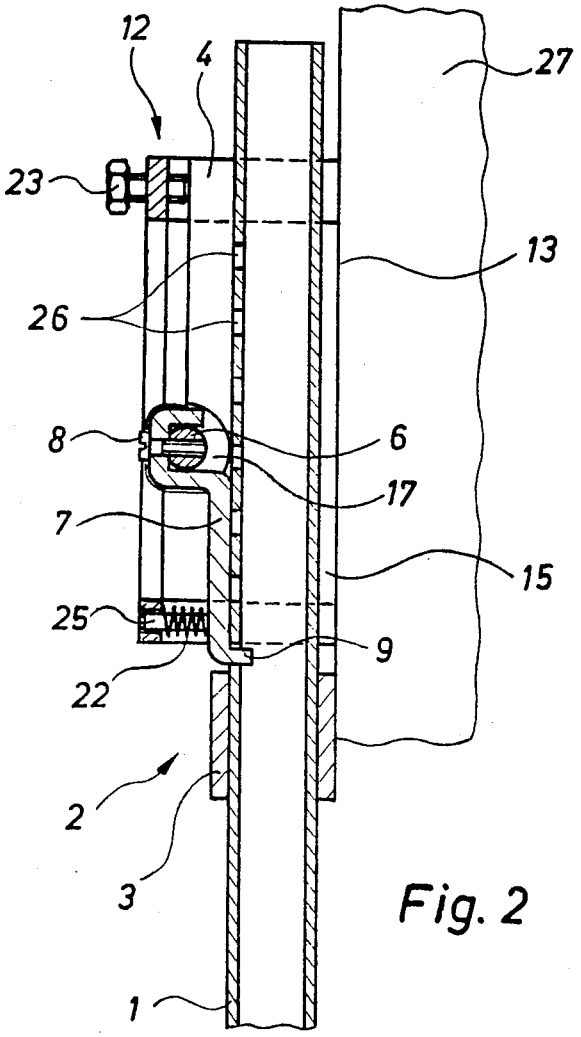
FIG. 2 is a section according to the line II—II in FIG. 1.

An adjusting member 2 is slidably mounted on an essentially horizontal back rest support 1, which is disposed on a stand or seat of a chair (not shown) and which consists of a hollow bar having a rectangular cross section. The adjusting member 2 has a lower bushing-like element 3 for guidance along the back rest support 1 and lateral, essentially vertically arranged mounting shanks 4 and 5, which are visible in FIG. 1 at their narrow sides. These mounting shanks 4 and 5 serve to mount a mounting bar 6 which is rotatable about its longitudinal axis and is connected with a lever-like detent member 7 of a detent means 7, 9, 22, 26, so as to rotate therewith, and futhermore, is secured in its position along the mounting bar 6 by means of screws 8. The detent member 7 has a detent pin 9 facing the back rest support 1, which detent pin 9 serves for the engagement in a detent hole 26 shown in FIG. 2 and is adapted therefor, which detent hole 26 belongs to a series of detent holes arranged at equal distances along the back rest support 1. As shown in FIG. 1, at its two laterally projecting, upwardly bent ends, the mounting bar 6 has activating members 10 and 11, which are formed as activating arms. With the aid of these activating members 10 and 11, the detent member 7 can be pivoted in such a manner that the detent pin 9 can be lifted out of the detent hole 26 which then detains it, and, after a sliding of the adjusting member 2, it can be engaged with another detent hole 26.

A frame-like mounting body 12, which includes brackets 13 through 16 to which the side of the back rest support 1 opposite the detent holes 26 is attached, is pivotally mounted on the mounting bar 6. Spacers 17 are located between the mounting shanks 4 and 5 and the mounting body 12. The mounting body 12 has lateral guide elements 18 and 19. One of the activating members 10, 11 arranged on the free ends of the mounting bar 6 is located in each vertical longitudinal slot 118, 119 in the guide elements 18 and 19. Respective activating knobs 20, 21 are arranged horizontally in the guide elements 18 and 19 and are disposed therein so as to be slidable perpendicular to the longitudinal axis of the mounting bar 6. The activating knobs 20, 21 cooperate with their associated activating members 10, 11 of the mounting bar 6 to rotate them about the longitudinal axis. A spring formed as a compression spring 22 is tensed between the mounting body 12 and the detent member 7 and is biased in the direction of holding the detent member 7 against the back rest support 1. The force exerted by the compression spring 22 on the mounting body 12 is transferred to the mounting shanks 4 and 5 by means of adjustable stop screws 23 and 24 which are screwed into the mounting body 12. The back rest 27 can be pivoted about the mounting bar 6 to the angle established by the stop screws 23, 24. The compression spring 22 surrounds a pin 25, which passes through the lower portion of the frame-like mounting body 12 with play and is attached to the detent member 7. At the level of the compression spring 22, at least one elastic compressed upholstery element can be arranged between the mounting body 12 and the adjusting member 2. Respective stop members, for example, in the form of stop screws, (not shown) are arranged at the top or bottom of the back rest support 1. They prevent an unintentional removal of the adjusting member 2 from the back rest support 1 and prevent this adjusting member 2 from being lowered too far.

By pressing one or both of the activating knobs 20 and 21, the activating members 10 and 11 are pivoted about the axis of the mounting bar 6 and the detent member 7 is thereby also rotated against the force of the compression spring 22, whereby the detent pin 9 is lifted out of the detent hole 26 which had been holding it and the adjusting member 2 can be adjusted along the back rest support 1. After the detent pin 9 engages in another detent hole 26, the adjusting member 2 is fixed in another position relative to the back rest support 1.

Figures 3, 4:
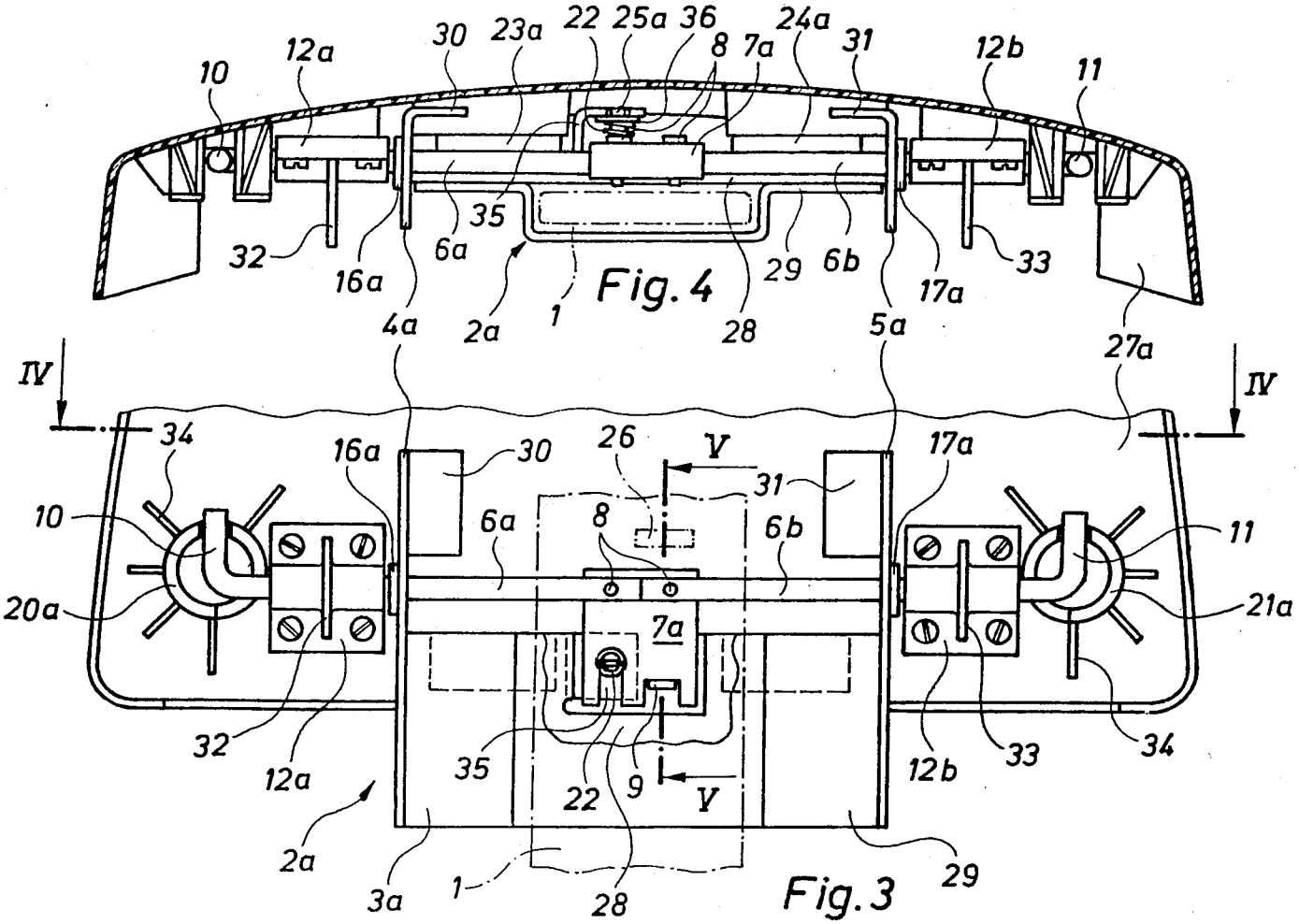
FIG. 3 is a rear view of a second exemplary embodiment having a cut-away portion.
FIGS. 4 and 5 are respective sections according to the lines IV—IV and V—V in FIG. 3.
Figure 5:
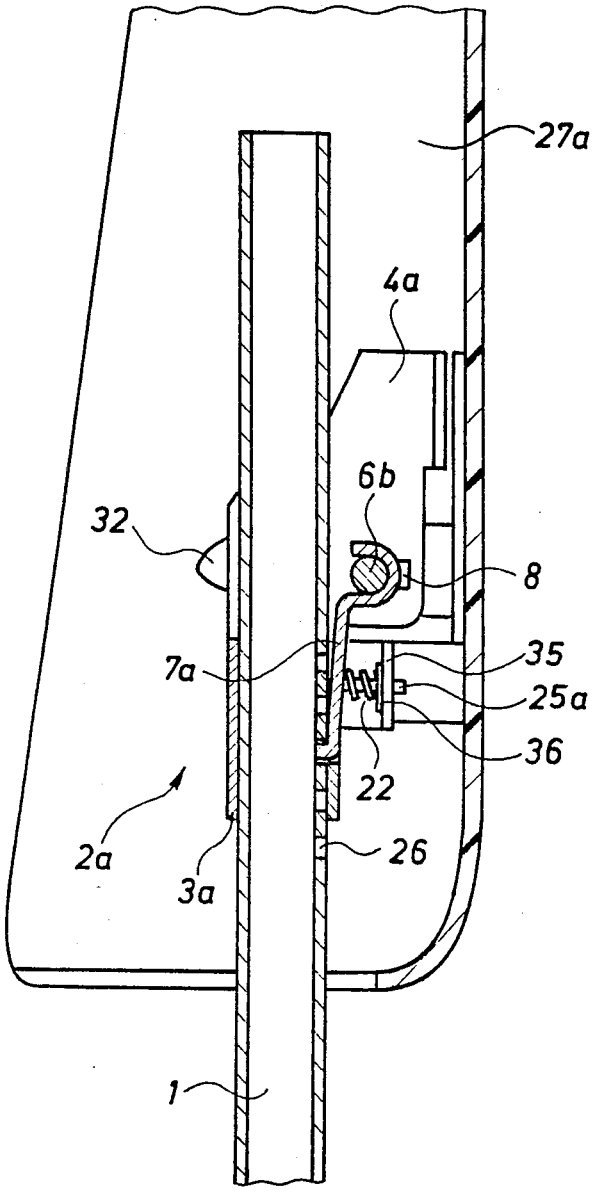

In the second exemplary embodiment according to FIGS. 3 through 5, elements similar to those in the first exemplary embodiment are designated with the same reference numerals, whereby changes are indicated by the letter a.

The bushing-like element 3a is formed of a wide U-shaped element 28 and a narrow U-shaped element 29, the shanks of which are bent outward and welded to the base of the element 28. The shanks of the element 28 are extended upward and form mounting shanks 4a and 5a, through which the double-element mounting bar 6a, 6b is passed. Curved tangs 30 and 31 arranged on the mounting shanks 4a and 5a in the vicinity of the back rest 27a serve in the support against the back rest 27a.

The two mounting bars 6a and 6b are held together at the front side by the lever-like detent member 7a, which is connected with the mounting bars 6a, 6b by means of screws 8. The detent pin 9, which is directed toward the back rest support 1, shown in broken lines in FIGS. 3 and 4, is located on the detent member 7a, and a pin 25a on the opposite side is directed toward the back rest 27a. The element 28 has an L-shaped support element 35, which points in the direction of the back rest 27a and is provided with an upwardly open recess for the passage of the pin 25a. The pin 25a is surrounded by the compression spring 22, which is supported between the detent member 7a and the support element 35, whereby a spring plate 36 is arranged between the support element 35 and the compression spring 22. The compression spring 22 biases the detent member 7a in the direction of its rest position, in which the detent pin 9 engages in one of the detent holes 26 in the back rest support 1.

The mounting bodies 12a and 12b, which are arranged at the sides of the adjusting member 2a, are attached to the back rest 27a with their connecting flanges and are penetrated in their mounting element by the mounting bars 6a, 6b. On the side of the mounting bodies 12a and 12b opposite the back rest 27a, there are arranged respective projecting lugs 32 and 33.

The activating knobs 20a and 21a are independently mounted in the back rest 27a so as to be slidable therein, whereby the respective mounting elements provided in the back rest 27a for the mounting of said knobs 20a and 21a are supported by braces 34. The activating members 10, 11 engage in the activating knobs 20a and 21a in such a manner that, when at least one of the activating knobs 20a, 21a is pushed, the mounting bar 6a is pivoted against the effect of the compression spring 22, whereby the detent pin 9 is lifted out of the detent hole 26 in the back rest support 1 which had just held it. The adjusting member 2a can then be adjusted along the back rest support 1.

The difference between the two exemplary embodiments is basically the fact that the compression spring 22 is supported at different locations and also the fact that the mounting body 12 in one case and the mounting bodies 12a and 12b in the other case can be formed differently. The mounting bodies 12a and 12b have a much simpler design than the mounting body 12. The second exemplary embodiment also requires less space than the first exemplary embodiment. The detent holes 26 are arranged on different sides in the two exemplary embodiments.

These two embodiments of the present invention are considered illustrative only since other modifications will be readily discerned by those skilled in the pertinent art. In any event, the scope of the invention is intended to be covered by both the letter and the spirit of the claims appended hereto.

I claim:

1. A chair with a height adjustable back rest, comprising:

a back rest support;

an adjusting member mounted on the back rest support and vertically movable relative thereto for supporting the back rest;

detent means for retaining the adjusting member on the back rest support, said detent means including detent holes in the back rest support, a detent pin adapted for insertion into one of the detent holes, and a compression spring against which the detent pin can be released, said detent means being arranged between the back rest support and the adjusting member;

said detent means further comprising at least one activating member;

bar means for pivotably mounting the activating member to the adjusting member; said bar means arranged horizontally through said adjusting member and formed with an upwardly bent end;

said detent means further comprising a detent member connected with the bar means so as to rotate therewith, said detent pin arranged on the detent member so as to cooperate with one of the detent holes in the back rest support;

wherein the back rest is mounted so as to be pivotable about the bar means and in that the compression spring is tensed between the detent member and one of a mounting body and a chair element which is rigidly connected with one of the adjusting member and the back rest, respectively.

2. The chair according to claim 1 wherein an activating knob is connected with the back rest to activate the activating member.

3. The chair according to claim 1, wherein mounting shanks are arranged on the mounting body and serve as stops for adjustable stop screws.

4. The chair according to claim 1, wherein the adjusting member and the bar means are arranged between the mounting body and the back rest.

5. An adjustable back rest for a chair, comprising:

a back rest support;

an adjusting member slidably disposed on the back rest support;

bar means pivotally disposed through the adjusting member;

a mounting body for a back rest pivotally mounted on the bar means;

a detent member fixed to the bar means;

spring means biasing the detent member into engagement with a hole in the back rest support; and activating means connected to the bar means for activating the detent member so as to disengage the detent member from the back rest support;

whereby the bar means provides pivotal mounting of both the mounting body and the detent member with respect to the adjusting member.

6. The back rest according to claim 5, wherein the back rest support has a plurality of holes therein in which the detent member can engage.

7. The back rest according to claim 6, further comprising a back rest mounted to the mounting body.

8. The back rest according to claim 5, wherein the spring means is disposed between the detent member and the mounting body.

9. The back rest according to claim 8, further comprising adjustable stop means disposed on the mounting body for limiting the pivoting movement of the mounting body.

* * * * *